United States Patent [19]

Yamagami et al.

[11] 4,253,291

[45] Mar. 3, 1981

[54] ELECTRONIC COMPONENTS ASSEMBLY APPARATUS AND METHOD FOR MAKING

[75] Inventors: Akio Yamagami; Tadashi Kubota, both of Katano, Japan

[73] Assignee: Matsushita Electric Industrial Co., Ltd., Kadoma, Japan

[21] Appl. No.: 101,186

[22] Filed: Dec. 7, 1979

[30] Foreign Application Priority Data

Dec. 11, 1978 [JP] Japan ..... 53-153501

[51] Int. Cl.[3] ..... B65B 15/04

[52] U.S. Cl. ..... 53/399; 53/391; 53/394

[58] Field of Search ..... 53/591, 594, 399; 206/330, 331; 29/741; 156/252, 301, 513, 560

[56] References Cited

U.S. PATENT DOCUMENTS

| | | | |
|---|---|---|---|
| 3,177,629 | 4/1965 | Anspach | 53/591 |
| 3,710,482 | 1/1973 | Gpafford | 156/560 X |
| 4,174,567 | 11/1979 | Kamoshida | 29/741 |

FOREIGN PATENT DOCUMENTS

| | | | |
|---|---|---|---|
| 7508744 | 1/1976 | Netherlands | 29/741 |

*Primary Examiner*—John Sipos

*Attorney, Agent, or Firm*—Cushman, Darby & Cushman

[57] ABSTRACT

An apparatus for making electronic component assembly comprising:

a first tape feeder for feeding a supporting tape to an assembly stage, a punching tool for making perforations with a predetermined pitch on said supporting tape, a feeding way for feeding electronic components near said assembly stage at then consecutively pushes said electronic component onto said supporting tape in said assembly stage, a rotating drum having around its outer face a number of projections to engage to said perforations and a number of guiding member to define positions of lead-wires of said electronic components when pushed onto said supporting tape, a second tape feeder for feeding a bonding tape onto said supporting tape at a position after said assembly stage in a manner not to cover said perforations and a bonding roller for pressing to bond said bonding tape onto said supporting roller with said lead-wires inbetween.

6 Claims, 8 Drawing Figures

ELECTRONIC COMPONENTS ASSEMBLY APPARATUS AND METHOD FOR MAKING

BACKGROUND OF THE INVENTION

1. Field of the Invention

The present invention relates to an improvement of electronic components assembly and method of making the same.

2. Prior Art

FIG. 1 and FIG. 2 show an example of electronic components assembly. The conventional electronic components assembly is made by putting lead-wires 2 of electronic components on a supporting tape 3, putting a bonding tape 4 thereon to hold the lead wires on the supporting tape 3, and thereafter forming perforations 5 for feeding and positioning. Such conventional electronic components assembly and method of making the same has such drawbacks that the lead-wires 2 are used as feeding and positioning means in the process of forming the perforations 5, thereby holding of the lead-wires bonded on the supporting tape 3 by the bonding tape 4 being liable to loosening. Such loosening of the lead-wires makes the position of the perforations in relation to those of the electronic components inaccurate, which causes an incorrect insertion of the components on printed circuit board in a later process.

SUMMARY OF THE INVENTION

The present invention purports to provide an improved electronic components assembly having an accurate interrelation between positions of the electronic components and perforations on a supporting sheet.

Particularly, the present invention concerns an improvement of electronic components assembly having a number of electronic components with its lead-wires fixed on a supporting tape by means of a bonding tape, the supporting tape having perforations.

DESCRIPTION OF PREFERRED EMBODIMENT

An electronic component assembly in accordance with the present invention comprises at least a supporting tape having perforations disposed with a predetermined pitch therealong, a bonding tape bonded on said supporting tape, a plural number of electronic components having parallel lead-wires on one side thereof, disposed with a predetermined distance with each other along said supporting tape and held with their lead-wires bonded on said supporting tape by said bonding tape, characterized in that said bonding tape is bonded on said supporting tape in a manner not to cover said perforations.

Method of making electronic component assembly in accordance with the present invention has the steps of forming perforations on a supporting tape with a predetermined distance from each other, transporting said supporting tape by engagements of projections provided around a rotating drum into said perforations, putting electronic components on predetermined positions of said supporting tape by guiding lead wires of said electronic components to said predetermined positions by guiding members which are provided on predetermined positions around said rotating drum, bonding at least a bonding tape on said supporting tape in a manner not to cover said perforations, thereby to bond said electronic component on said supporting tape.

An apparatus for making electronic component in accordance with the present invention comprises, a first tape feeder for feeding a supporting tape to an assembly stage, a punching tool for making perforations with a predetermined pitch on said supporting tape, a feeding way for feeding electronic components near said assembly stage and then consecutively pushes said electronic component onto said supporting tape in said assembly stage, a rotating drum having around its outer face a number of projections to engage to said perforations and a number of guiding member to define positions of lead-wires of said electronic components when pushed onto said supporting tape, a second tape feeder for feeding a bonding tape on to said supporting tape at a position after said assembly stage in a manner not to cover said perforations and a bonding roller for pressing to bond said bonding tape onto said supporting roller with said lead-wires inbetween.

A preferred embodiment of the present invention is elucidated referring to FIGS. 3, 4, 5 and 6.

Figure 1:
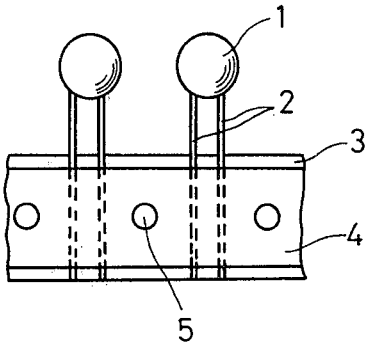
FIG. 1 is a front view of a conventional electronic components assembly.
Figure 2:
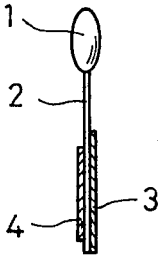
FIG. 2 is a sectional side view of the electronic components assembly of FIG. 1.
Figure 3:
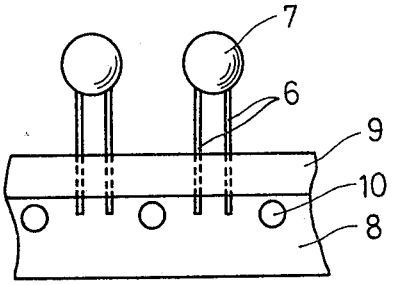
FIG. 3 is a front view of an electronic components assembly embodying the present invention.
Figure 4:
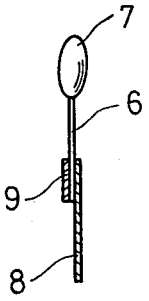
FIG. 4 is a sectional side view of the electronic components assembly of FIG. 3.

A number of electronic components 7, such as resistors, capacitors, inductors, diodes, transistors, etc., each having lead-wires 6 parallelly on the same side, are fixed with their lead-wires 6 bonded on a supporting tape 8, by means of a bonding tape 9 bonded thereon in a manner not to cover perforations 10 on the supporting tape 8 as shown in FIGS. 3 and 4, thus forming an electronic components assembly.

Figure 5:
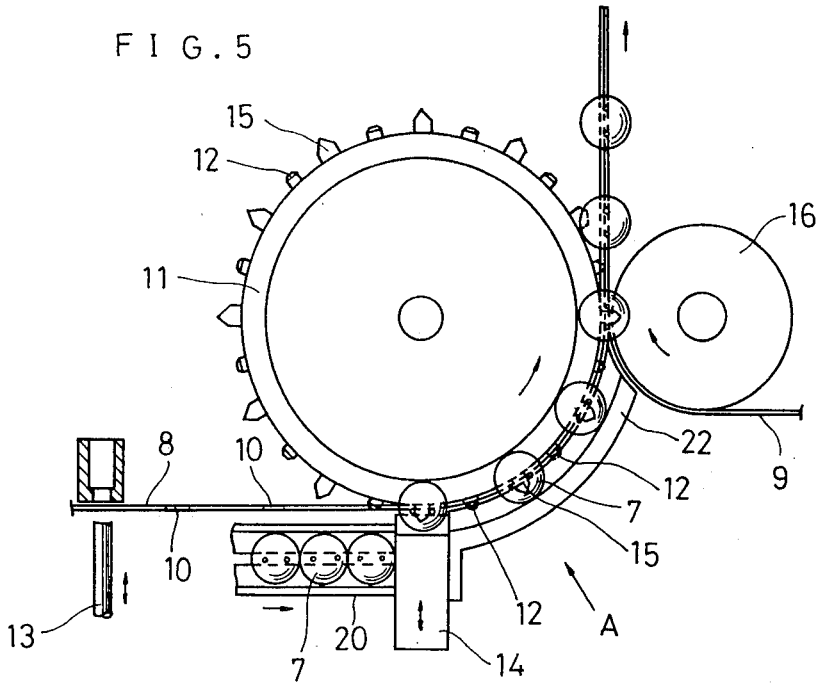
FIG. 5 is a front view of an apparatus for making the electronic components assembly in accordance with the present invention.
Figure 6:
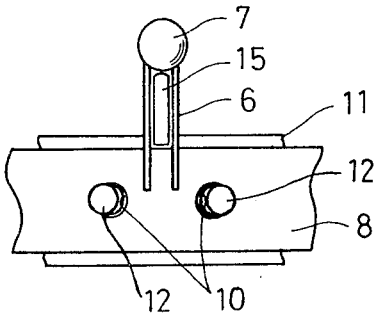
FIG. 6 is a view seen from the direction shown by an arrow A of FIG. 5.

In FIG. 5 which shows making apparatus of the electronic components assembly, the supporting tape 8 is fed from left side of FIG. 5 and is punched by a punching tool 13, so that perforations 10, 10, . . . are sequentially formed with predetermined distances from each other. The punched supporting tape 8 is driven rightwards by engagements of perforations 10, 10, . . . to the protrusions 12, 12, . . . which are provided on a drum 11 with a predetermined pitches inbetween. The drum 11 rotates in the anti-clockwise direction by a known manner.

The electronic components 7, 7, . . . are sequentially fed from a left side of a feeding way 20 rightwards, and are one by one pushed up by means of the pushing rod 14 which are reciprocally moving back and forth. When being pushed forward, the lead-wires 6, 6 of the electronic components 7 are guided by a guiding members 15, 15, . . . which are protrusions provided on the drum 11. Since the guiding members 15, 15, . . . are provided between the protrusions 12, 12, . . . with accurate position relation on the drum, the electronic components pushed foward on the supporting tape 8 are disposed on right positions in relation to the perforations. An arc shaped cover plate 22 guides the electronic components 7 not to drop off the guiding members 15, 15, . . . .

A known bonding tape 9, is fed leftwards from the right end part of FIG. 5, by a bonding roller 16, onto the supporting tape 8, and is pressed thereon by pinching both tapes between the drum 11 and the bonding roller 16. By the pressing, the bonding tape 9 is bonded on the supporting tape 8, thereby fixing lead-wires 6, 6 of the electronic components to the supporting tape 8. The bonding tape is bonded in a manner not to cover the perforations 10, 10, . . . . The reason why the bonding position of the bonding tape is selected not to cover the perforation is to eliminate a need of punching perforations on the bonding tape and registration of the perforation of the supporting tape and the bonding tape.

The bonding can be made by thermo-setting of bonding resin film by heating or by suitable known other method.

Thus the electronic components 7, 7, . . . are bonded on the supporting tape 8 having perforations with a predetermined pitches by fixing their lead-wires by a bonding tape 9, which is bonded on the supporting tape 8 in a manner not to cover the perforations 10, 10, . . . . The positions of the electronic components 7, 7, . . . in relation to that of the perforations 10, 10, . . . are assured with sufficient accuracy, since both the perforations 10, 10, . . . and lead-wires 6, 6, . . . of the electronic components are accurately defined by accurate relation of the positions of the protrusions 12, 12, . . . and the guiding members 15, 15, . . . .

As is clear from the abovementioned elucidation of the embodiment, the accuracy of the positions of the perforations and lead-wires of the electronic components are controlled with sufficient accuracy by utilizing the drum having protrusions 12, 12, . . . to be engaged to the perforations 10, 10, . . . and guiding members 15, 15, . . . on its cylindrical outer face. Furthermore, since the supporting tape 8 is driven by engagement of the protrusions 12, 12, . . . to the perforations, 10, 10, . . . , the lead-wires are free from a force to drive the supporting tape 8. Moreover, since a relatively narrow bonding tape 9 is used, the cost of the making of the electronic components can be drastically reduced.

The present invention is applicable not only to the electronic component assembly for automatic assembly of electronic circuit, but also to wrapping of the electronic components for retail.

Figure 7:
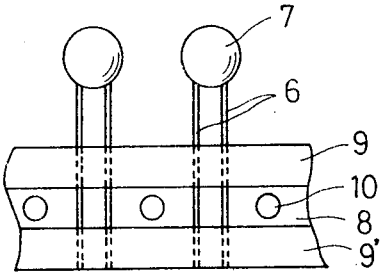
FIG. 7 is a front views of another electronic components assembly in accordance with the present invention.
Figure 8:
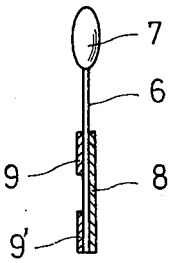
FIG. 8 is a sectional side view of the electronic components assembly of FIG. 7.

FIG. 7 and FIG. 8 shows another example, wherein two parallel bonding tapes 9 and 9' are bonded on a supporting tape to fix lead-wires of electronics components.

Furthermore, the shape of the guiding member 15, 15, . . . is not necessary limited to protrusions, but also can be recesses, or further can comprise a member to hold bodies of the electronic components.

The perforations, 10, 10, . . . can be, not only round holes, but also holes or recesses of any other shapes such as square holes, or triangular recesses of known arts.

What is claimed is:

1. A method of making electronic component assembly comprising the following steps:

forming perforations on a supporting tape with a predetermined distance from each other, transporting said supporting tape by engagements of projections provided around a rotating drum into said perforations, putting electronic components on predetermined positions of said supporting tape by guiding lead wires of said electronic components to said predetermined positions by guiding members which are provided on predetermined positions around said rotating drum, bonding at least a bonding tape on said supporting tape in a manner not to cover said perforations, thereby to hold lead-wires of said electronic component on said supporting tape.

2. A method of making electronic component assembly in accordance with claim 1 wherein said electronic component is carried to a position for bonding, retaining its relative position with respect to said supporting tape by said guiding members whose positions are defined by engagement of projections to said perforations.

3. A method of making electronic component assembly in accordance with claim 1 or 2, wherein said bonding is made by thermal setting of bonding resin.

4. An apparatus for making electronic component assembly comprising:

a first tape feeder for feeding a supporting tape to an assembly stage, a punching tool for making perforations with a predetermined pitch on said supporting tape, a feeding way for feeding electronic components near said assembly stage and then consecutively pushing said electronic component onto said supporting tape in said assembly stage, a rotating drum having around its outer face a number of projections to engage into said perforations and a number of guiding member to define positions of lead-wires of said electronic components when pushed onto said supporting tape, a second tape feeder for feeding a bonding tape onto said supporting tape at a position after said assembly stage in a manner not to cover said perforations and a bonding roller for pressing to bond said bonding tape onto said supporting roller with said lead-wires inbetween.

5. An apparatus for making electronic component assembly in accordance with claim 4, wherein said guiding member is protrusions on both sides of which said lead-wires are put to define positions thereof.

6. An apparatus for making electronic component assembly in accordance with claim 4 or 5, wherein said bonding roller is a roller to heat said bonding tape for thermal setting of bonding resin.

* * * * *